US010570600B2

(12) United States Patent
Holguin

(10) Patent No.: US 10,570,600 B2
(45) Date of Patent: Feb. 25, 2020

(54) DISPENSING SYSTEM FOR TOILET BOWL CLEANSER

(71) Applicant: Edgar Holguin, Monterey Park, CA (US)

(72) Inventor: Edgar Holguin, Monterey Park, CA (US)

(73) Assignee: Edgar Holguin

( * ) Notice: Subject to any disclaimer, the term of this patent is extended or adjusted under 35 U.S.C. 154(b) by 74 days.

(21) Appl. No.: 16/066,223

(22) PCT Filed: May 2, 2017

(86) PCT No.: PCT/US2017/030514

§ 371 (c)(1),
(2) Date: Jun. 26, 2018

(87) PCT Pub. No.: WO2017/192492

PCT Pub. Date: Nov. 9, 2017

(65) Prior Publication Data

US 2019/0360189 A1 Nov. 28, 2019

Related U.S. Application Data

(60) Provisional application No. 62/332,012, filed on May 5, 2016.

(51) Int. Cl.
*E03D 9/03* (2006.01)

(52) U.S. Cl.
CPC ..... *E03D 9/038* (2013.01)

(58) Field of Classification Search
CPC ..... E03D 9/038
USPC ..... 4/227.6
See application file for complete search history.

(56) References Cited

U.S. PATENT DOCUMENTS

| | | | |
|---|---|---|---|
| 6,151,722 | A | 11/2000 | Lubrano |
| 6,240,572 | B1 | 6/2001 | Van Der Gaag et al. |
| 6,662,379 | B2 | 12/2003 | Nguyen et al. |
| 6,944,890 | B1 | 10/2005 | Sim |
| 8,453,272 | B2 | 6/2013 | Sim |
| 8,719,971 | B2 | 5/2014 | Burt et al. |
| 2006/0242754 | A1 | 11/2006 | Coppock |
| 2007/0289054 | A1 | 12/2007 | Han et al. |
| 2009/0265842 | A1 | 10/2009 | Higgins et al. |

OTHER PUBLICATIONS

Patent Cooperation Treaty, "International Preliminary Report on Patentability" dated Nov. 15, 2018 for PCT/US2017/30514 filed May 2, 2017, 9 pages.
Patent Cooperation Treaty, "International Search Report" for PCT/US2017/30514 filed May 2, 2017, 4 pages.

(Continued)

*Primary Examiner* — Christine J Skubinna

(57) ABSTRACT

A device for dispensing toilet bowl cleaner from a toilet tank to the toilet bowl comprises a housing, an outlet from the housing, a rim around the outlet, a cleaner chamber for receiving toilet bowl cleaner material, and a water inlet chamber for receiving substantially all the water used during flushing. There is a cleaner chamber receiving a portion of the water flowing into the water inlet chamber with passages for water to flow into the cleaner chamber where water dissolves cleaner material. The rim is configured to limit the exposure of the cleaner material to water between flushes.

30 Claims, 6 Drawing Sheets

(56) References Cited

OTHER PUBLICATIONS

Patent Cooperation Treaty, "Written Opinion of the International Searching Authority," for PCT/US2017/30514 filed May 2, 2017, 10 pages.
Amazon, "NeverScrub Automatic Toilet Cleaning System," 7 pages.
Amazon, "Clean My Potty for Me Please #KaboomClean," 6 pages.
Kaboom, "Kaboom™ Scrub Free!™ Toilet Cleaning System," 3 pages.
Cool Tools, "Kaboom Scrub Free Toilet Cleaning System," 8 pages.
Fluidmaster, Inc., "The easiest and most effective way to keep your toilet bowl clean," 2014, 2 pages.

DISPENSING SYSTEM FOR TOILET BOWL CLEANSER

CROSS-REFERENCE TO RELATED APPLICATIONS

This application claims the benefit of U.S. Provisional patent application Ser. No. 62/332,012 filed on May 5, 2016, which is incorporated herein in its entirety by reference.

BACKGROUND

It is known to use toilet bowl cleaners placed in a toilet tank for flow into the toilet bowl during the flushing process. Toilet bowl cleaners are available in many shapes and sizes; a popular shape is a cylindrical cake. Cleaner can be used for disinfecting toilet bowls and preventing lime build-up.

Devices for dispensing toilet bowl cleaner into the toilet bowl are known, such as those described in U.S. Pat. Nos. 6,151,722; 6,240,572; 6,662,379; and 8,719,971; US Patent Publication Nos. 20060242754; 20070289054; 20090265842.

A challenge with prior art cleaner disposing devices is the speed at which the cleaner material is consumed. The cleaner can be exposed to rushing water or sit in water between flushes, thereby resulting in unnecessarily high concentrations of cleaner in the toilet bowl and fast consumption of cleaner. Not only is this environmentally unsound, but unduly requires purchase of additional cleaner and the effort of refilling the cleaner dispenser.

Therefore there is a need for a device for dispensing cleaner that reduces the rate of consumption.

SUMMARY

The present invention satisfies this need. In particular the present invention provides a system for dispensing toilet bowl cleaner from a toilet tank to a toilet bowl. It is useful with a typical toilet tank that has a water inlet tube and an overflow tube. The system includes a device comprising a housing, and an outlet for water flow from the device and configured for water passage connection to the overflow tube and an outlet from the housing, the outlet being configured for water passage connection to the overflow tube. There is a rim around the outlet. A cleaner chamber in the housing is for receiving the toilet bowl cleaner material, wherein the cleaner chamber has a bottom. There is also a water inlet chamber within the housing for receiving substantially all of the water from the water inlet tube and configured so that a portion of water entering the water inlet chamber can pass directly over the rim into the outlet.

There are one or more than one cleaner chamber passages to the cleaner chamber for a portion of the water passing into the water inlet chamber to pass into the cleaner chamber and for water containing cleaner to pass out of the cleaner chamber for passage to the outlet. The rim in configured to avoid soaking the cleaner material with water between flushes. For example the least elevated portion of the rim can be no more than 10 mm higher than the bottom of all the cleaner chamber passages, or that the cleaner chamber has no water therein between flushes. The lease elevated portion of the rim can be below the height of the bottom of all the cleaner chamber passages. Stated another way, the rim is preferably configured and sized and located so that between flushes the cleaner chamber is less than one half full of water, and more preferably less than one quarter full of water.

There can be a barrier in the cleaner chamber proximate to at least one passage, serving as a baffle in preventing non-dissolved cleaner material from passing out of the cleaner chamber.

There can be a space between the housing bottom and the bottom of the cleaner chamber, with openings in the bottom of the cleaner chamber for drainage of water and cleansing material into the space, the openings serving as cleaner chamber passages.

The device can be formed from first and second components, where the first component fits into the second component.

There can be a water loading chamber between the water inlet chamber and the cleaner chamber passages. The loading chamber can be below the cleaner chamber. When in use, the device is installed in a toilet with a cake of toilet bowl cleaner in the cleaner chamber.

DRAWINGS

These and other features, aspects, advantages of the present invention will become better understood with the following description, appended claims, and accompanying drawings, where:

DESCRIPTION

Figure 1:
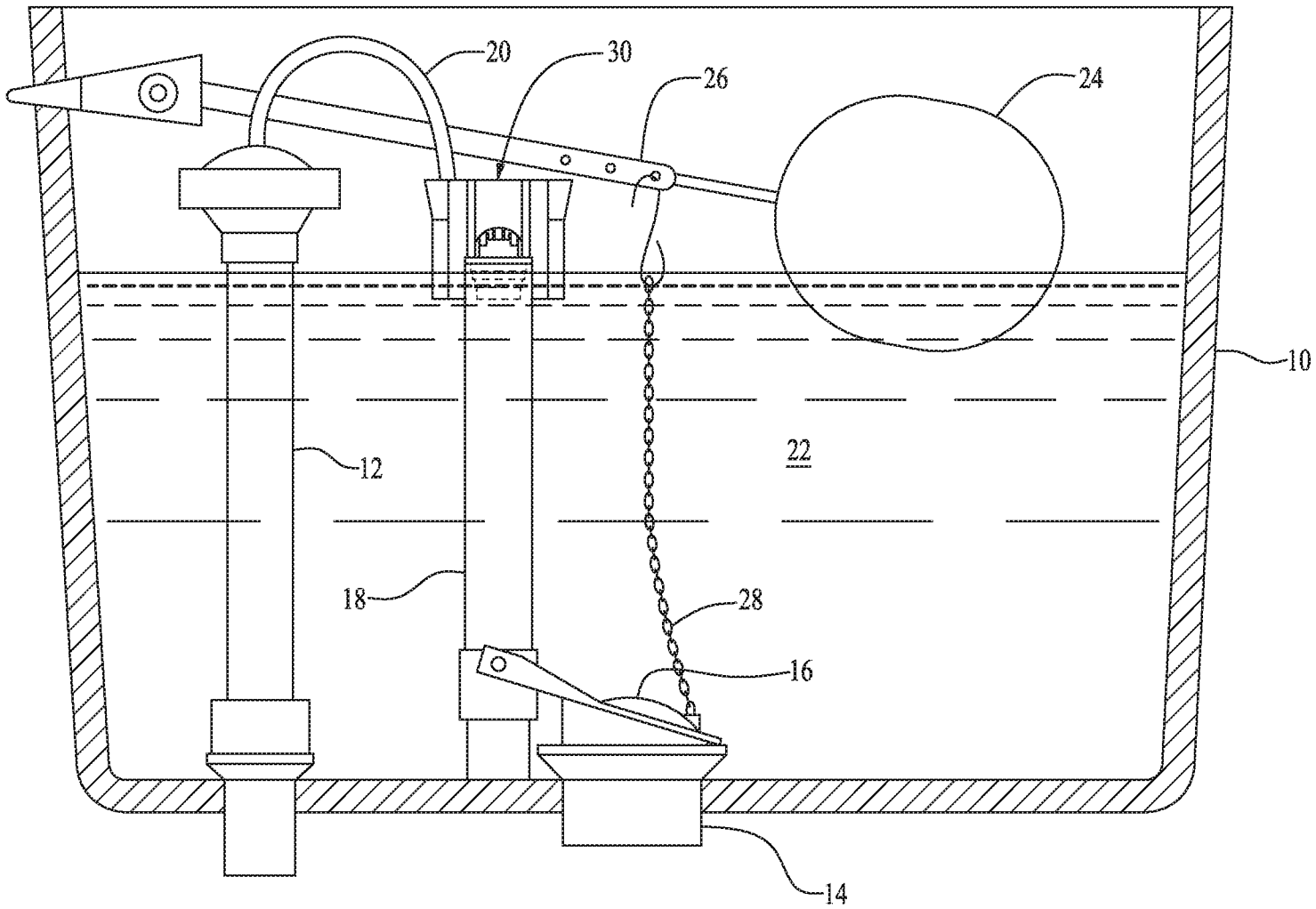
FIG. 1 is a partial sectional view of a toilet tank with a device having the features of the present invention installed.
Figure 2:
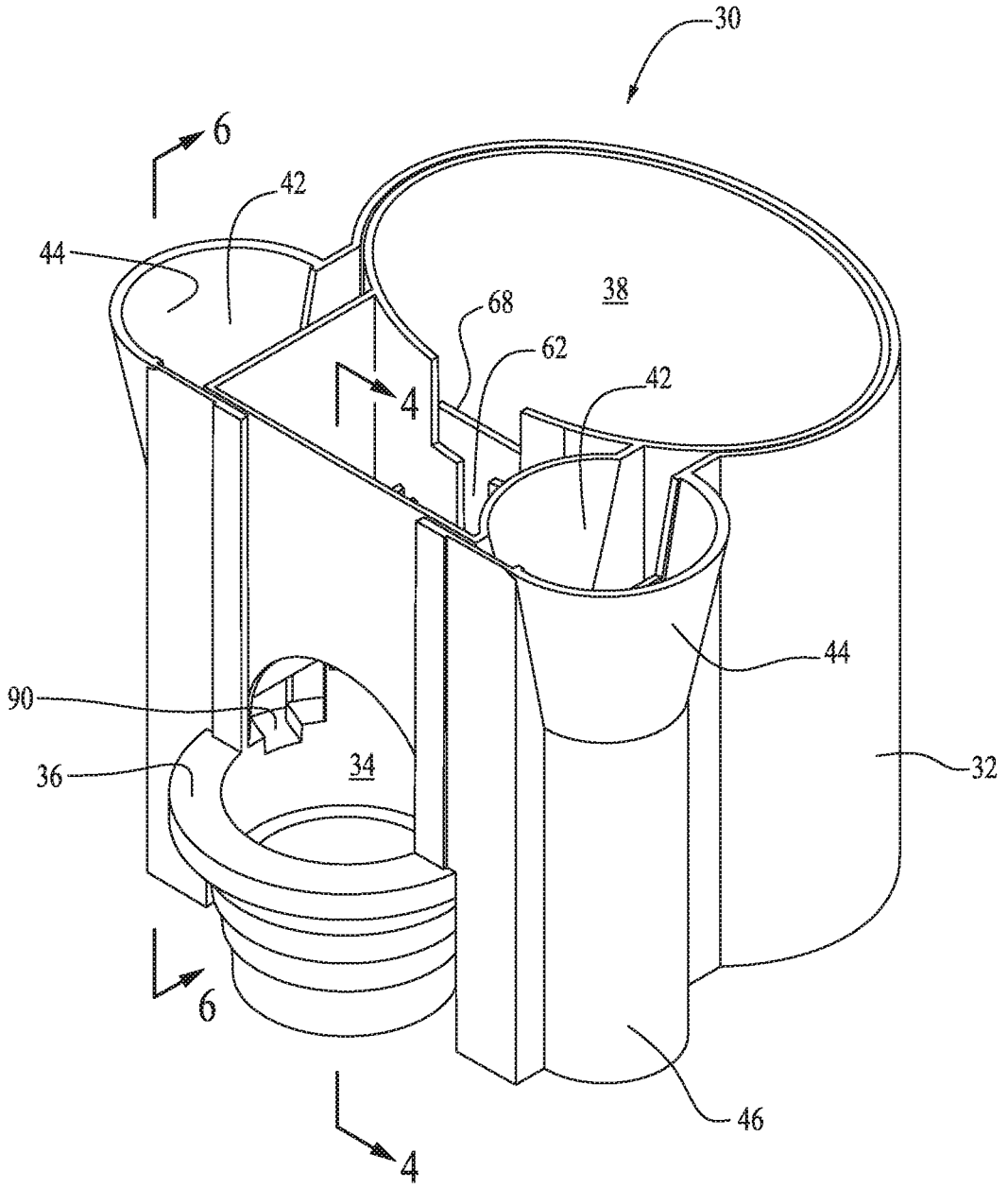
FIG. 2 is a perspective view of the device of FIG. 1 having the features of the present invention.

With reference to FIG. 1, there is shown a typical toilet tank 10 provided with a fill line 12, a tank drain 14 provided with a flapper valve 16, an overflow tube 18, and a water inlet tube 20 dispensing water from the fill line 12. The tank 10 contains water 22 on which floats a float 24 at the end of an arm 26 and provided with a chain 28 connected to the valve 16 for raising the valve 16 for flushing and, as the float 24 lowers, allowing the valve 16 to close.

A dispensing device 30 having features of the present invention is positioned on top of the overflow tube 18 and positioned to receive water from the water inlet tube 20.

With reference to FIGS. 2-6, the dispensing device 30 comprises a housing 32, and an outlet 34 from the housing with a rim 36 around the outlet 34 and extending upwardly. The outlet 34 is for passing water from the device 30 and is configured for water passage connection to the overflow tube 18. The device includes a cleaner chamber 38 for receiving toilet bowl cleaner 40, and water inlet chambers 42 within the housing. One of the water inlet chambers 42 receives substantially all of the water from the water inlet tube 20 and is configured so that water entering the water inlet chamber 42 can pass over the rim 36 to the outlet 34. Generally only one inlet chamber 42 is used. Two water inlet chambers 42 located opposite from each other are provided so the device 30 can easily be used with different toilet bowl configurations.

Each water inlet chamber 42 preferably is configured with an upper funnel shaped section 44, the wider portion of the funnel at the top, for ease in receiving water. A lower section 46 of the water inlet chamber is generally an elongated right cylinder.

Figure 4:
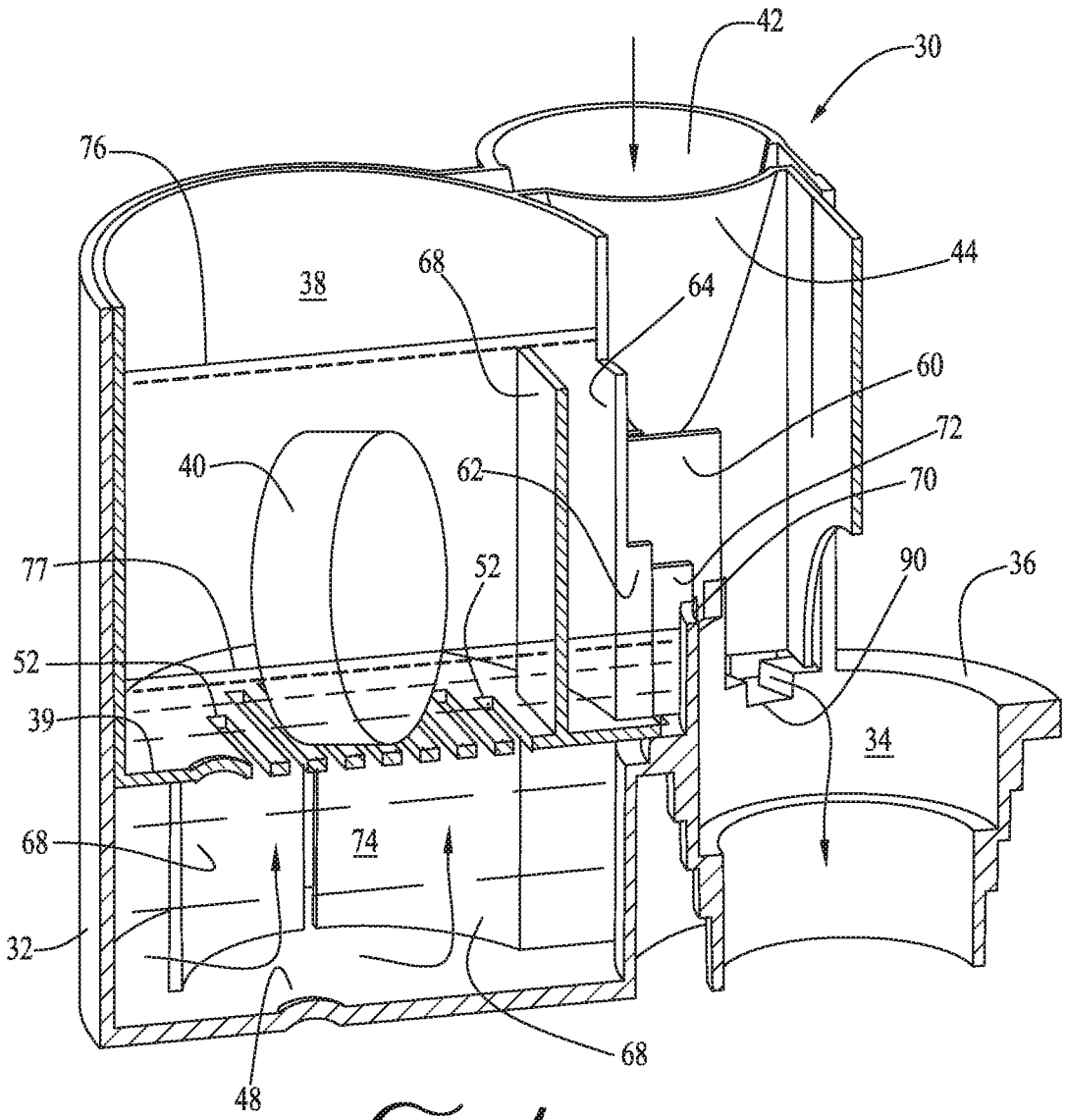
FIG. 4 is a partial sectional view of the device of FIG. 1 taken on line 5-5 in FIG. 2.
Figure 5:
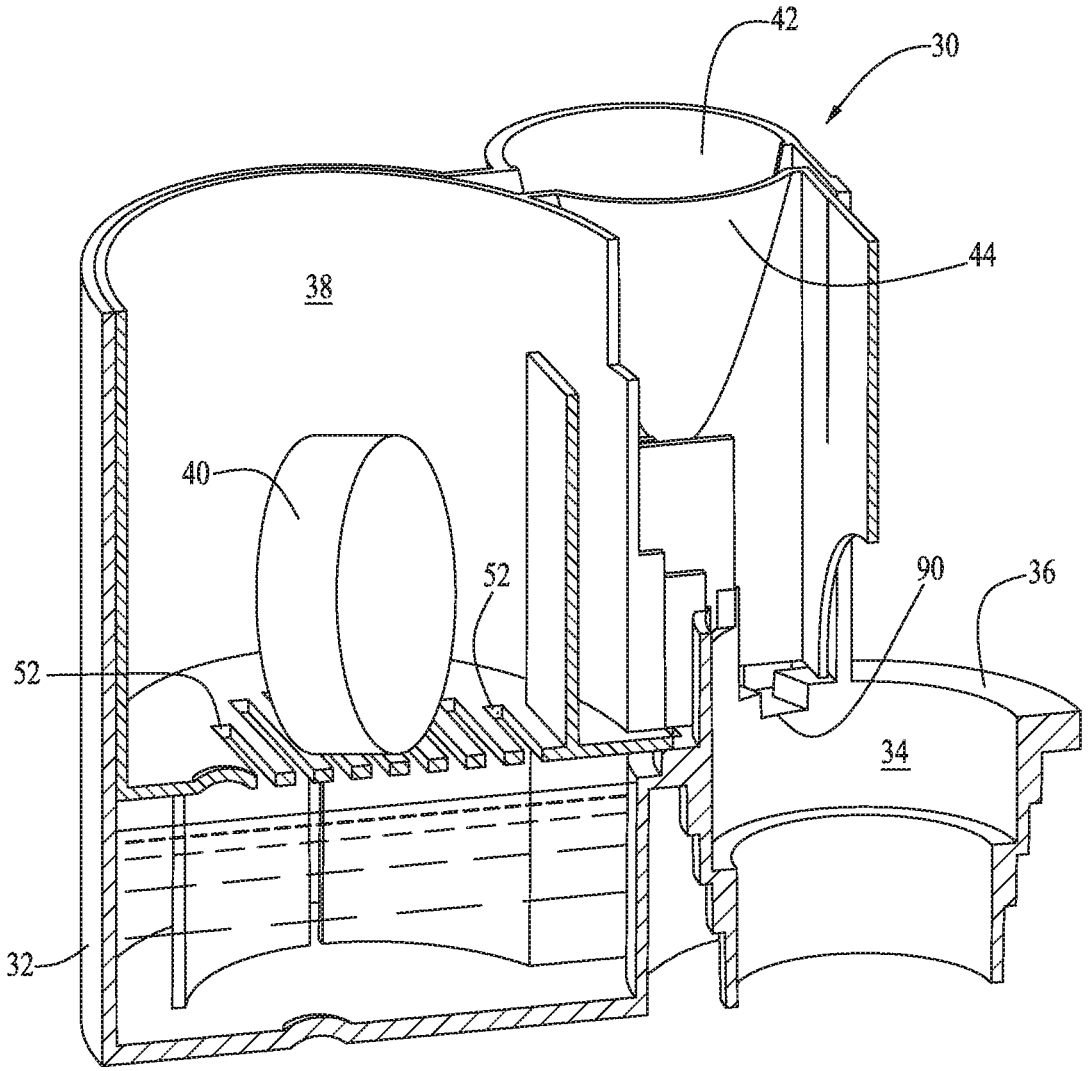
FIG. 5 is a partial sectional view of the device of FIG. 4 taken on line 5-5 in FIG. 2.
Figure 6:
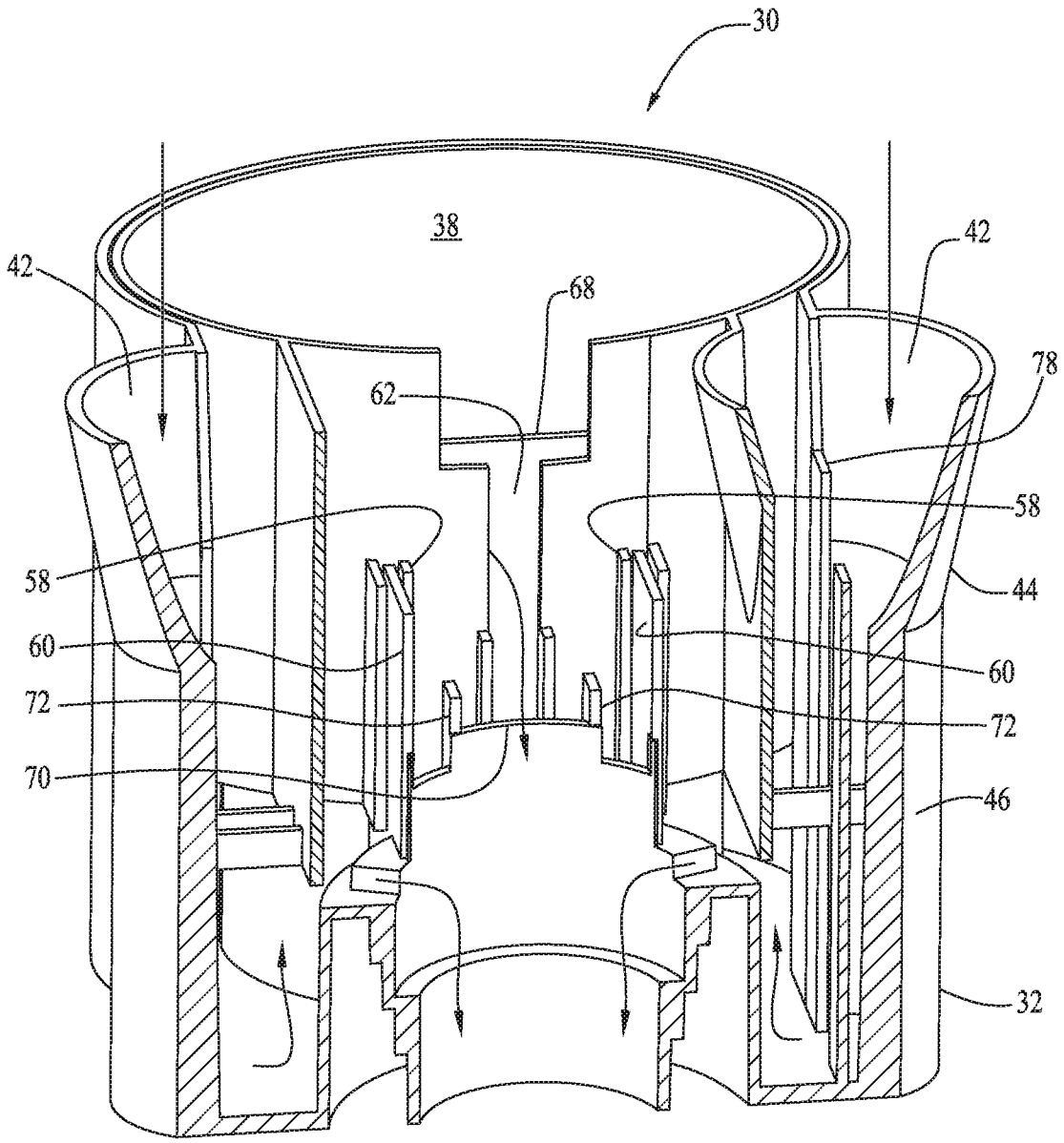
FIG. 6 is another partial sectional view of the device of FIG. 2 taken on line 6-6 in FIG. 2.

The cleaner chamber 38 has a bottom 39 and is sized and configured to accommodate commercial cleaner materials, which are frequently in the shape of a cake or tablet 40 as shown in FIGS. 4 and 5. A cake of the tablet cleaner 40 can be positioned with a flat surface facing downwardly, or upright with the curved rim surface on the cleaner chamber bottom 39 as shown in FIGS. 4 and 5. The cleaner chamber 38, although shown as oval in horizontal cross section, can be any shape to accommodate cleaner materials. For example it can be in horizontal cross section circular or square. It need not be uniform in horizontal cross section, such as being formed to taper inwardly towards the bottom. For example it is possible to configure the cleaner chamber 38 to only accommodate a proprietary cleaner so that the device can be used only with a particular cleaner material, which would allow a manufacture to provide the device at a reduced price or for free for increased sales with regard to its own cleansing material. For example the chamber 38 can be provided with a plurality of projections such as spikes from the walls and/or bottom extending inwardly into the chamber, where the cleaner 40 has recesses or holes located and configured to fit over the projections.

The bottom 39 of the cleaner chamber has at least one opening, and preferably a plurality of openings 52, for water passage into and out of the cleaner chamber 38. The water is used for dissolving cleaner material for passage through the openings 52 into the toilet bowl via the outlet 34 by passing over the rim 36. The openings 52 are shown as slots in the figure, but they can be of any desired shape or configuration or number. It is important that water can flow easily into and out of the cleaner chamber 38, so the openings 52 need to be sufficiently large that they are not plugged by cleaner material 40. Moreover, preferably the openings 52 are configured so that there are openings around the external of the periphery of the cleansing material 40 and/or there are projections on the chamber bottom 39 so that the cleaner material does not block the openings 52. Thus, the openings 52 serve as cleaner chamber passages so that a portion of the water flowing into the water inlet chamber 42 passes into the cleaner chamber 38 and water containing cleaner can pass out of the cleaner chamber 38 for passage to the outlet 34.

Figure 3:
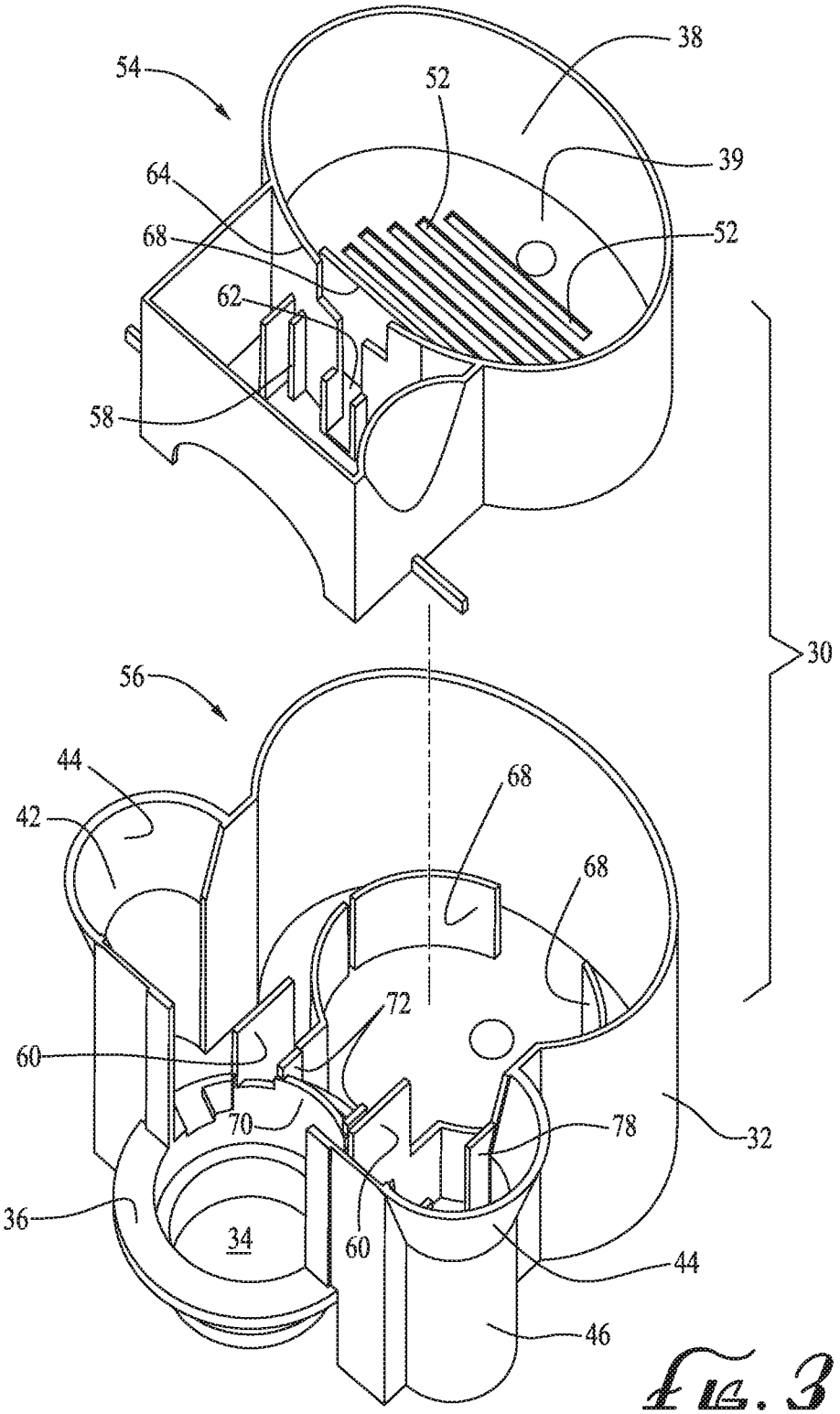
FIG. 3 is an exploded perspective view of the device of FIG. 2.

For ease of manufacture, optionally the device 30 can be assembled from two parts or components as shown in FIG. 3, comprising an internal component 54 that slides into an external component 56. The two components can be formed by injection molding. The internal component 54 is provided with a protrusion 58 that slides in between corresponding arms 60 of the external component 56 to assist in aligning the two components when assembled together. An advantage of having two components is that the internal component 54, which provides the cleaner chamber 38, can be lifted out of the external component 56 for placement of cleaner material 40 without having to disengage the external component 56 from either the overflow tube 18 or the water inlet fill line 20.

Additional water passage into and out of the cleaner chamber 38 is provided by a vertically oriented slot 62 at the bottom of the wall 64 forming the cleaner chamber 38, the slot 62 being positioned proximate to the rim 36 of the outlet 34. Optionally an outlet baffle is provided proximate the slot 62 for limiting the velocity of water flowing into and out of the chamber and for laterally dispersing the inlet flow. In addition to this outlet baffle, optionally baffles 68 can be provided in the cleaner chamber 38 around the bottom periphery thereof. These additional baffles 68 can be sized and positioned for retaining a tablet shaped cleansing material in the cleaner chamber 38 and thus perform two functions: baffling the water flow and retention of the tablet. Preferably one of the baffles is proximate to the slot 62 for baffling water flowing into the chamber 38 through the slot and baffling water flowing out of the chamber 38 through the slot 62.

An external baffle 70 can be provided adjacent the slot 62 external to the cleaner chamber 38, and can be U-shaped in general configuration with arms 72 extending toward the wall 64 of the cleaner chamber for spreading out water flow.

The bottom 48 of the housing 32 and the bottom 39 of the cleaner chamber 38 are spaced apart from each other, thereby providing a loading chamber 74. This loading chamber 74 allows smoothing out of water surges.

The arrows in the drawings show water flow. When a toilet is flushed, substantially all water flows into one or both of the water inlet chambers 42. Some of the water flows to the outlet 20, without flowing into the cleaner chamber 38, for passage to the toilet bowl. Some water flows through water passages 52 and 62, and into the cleaner chamber 38. The device 30 is designed so that only a portion of the water that goes into the water inlet chamber 42 flows into the cleaner chamber 38. When a loading chamber 74 is provided, water flows into the loading chamber 74 before passing through the water passages 52. How much water enters the cleaner chamber 38 depends on many factors, including the flow rate of the water flowing into the water inlet chamber 42. It is desired that the inlet chamber be substantially filled when flushing, such as shown by phantom water line 76 in FIG. 4. During the flushing, the cleaner material can be totally submerged or partially submerged. As the cleaner material is consumed, it is more likely to be totally submerged.

Eventually water drains out of the cleaner chamber 38, receding through water passages such as the slot 62 and the openings 52, the water containing dissolved cleaner material, and thereafter passes over the rim 36 into the outlet 34.

A preferred feature of the present invention is to extend the life of toilet bowl cleaner by not having the cleaner submerged in water between flushes, which increases the rate at which the cleaner is consumed. Between flushes there can be no water in the cleaner chamber as shown in FIG. 5, or the cleaner can be partially submerged as shown by water line 77 in FIG. 4. Thus the device 30 can be configured so that only some or none of the cleaner is in contact with water between flushes. This is principally controlled by the relative height of the rim, in particular the lowest portion part of the rim, to the bottom of the cleaner chamber passages. There are multiple ways to express this relationship. For example preferably the least elevated portion of the rim is no more than 10 mm higher than the bottom of all of the cleaner chamber passages, and more preferably below the height of the bottom of all of the cleaner chamber passages. Another way of expressing this is preferably the rim is configured so that between flushes the cleaner chamber is less than one half full (less than 50%) of water, and more preferably less than one quarter full of water. The percentage fill is with regard to the chamber without cleaner therein.

Preferably the device 30 is made of a plastic, although it can be made of corrosion resistant metal. Plastic is preferred due to light weight, durability, and general non-reactivity with cleaner material. Among the suitable plastics are polyethylene, polystyrene, acrylonitrile-butadiene-styrene copolymer, and other copolymers.

Although the present invention has been described in considerable detail with regard to preferred versions thereof, other versions are possible. For example the device 30 can be provided with inlet tube positioners 78 that are in each water inlet chamber 42 for holding the water inlet fill tube 20 in position. Also although the rim 36 is shown having a uniform height, it need not be. There can be a slot 90 or hole or the like in the rim 36, where the bottom of the slot or the hole is the lowest portion of the rim.

Therefore the scope and spirit of the appended claims not being limited to the preferred versions contained herein. All of the features disclosed in the specification including any accompanying claims, abstract and drawings can be replaced by alternative features serving the same equivalent or similar purpose unless expressly stated otherwise. Also the various features disclosed need not be in every version of the invention, and can be used in various combinations of features, including all the features.

What is claimed is:

1. A device for dispensing toilet bowl cleaner from a toilet tank to a toilet bowl of a toilet, the toilet tank having a water inlet tube and an overflow tube, the device comprising:

a. a housing;

b. an outlet for water flow from the device and configured for water passage connection to the overflow tube;

c. a rim around the outlet;

d. a cleaner chamber in the housing for receiving toilet bowl cleaner, the cleaner chamber having a bottom;

e. a water inlet chamber within the housing for receiving substantially all of the water from the water inlet tube and configured so that water entering the water inlet chamber can pass over the rim to the outlet;

f. one or more cleaner chamber passages to the cleaner chamber for a portion of the water flowing into the water inlet chamber to pass into the cleaner chamber and for water containing cleaner to pass out of the cleaner chamber for passage to the outlet; and wherein the least elevated portion of the rim is below the height of the bottom of all of the cleaner chamber passages.

2. The device of claim 1 comprising a barrier in the cleaner chamber proximate to at least one passage.

3. The device of claim 1 wherein the housing has a bottom with a space between the bottom of the housing and the bottom of the cleaner chamber, and wherein there are openings in the bottom of the cleaner chamber for drainage of water and cleansing material into the space.

4. The device of claim 1 formed from first and second components, wherein the first component fits into the second component.

5. The device of claim 1 wherein the rim is configured so that between flushes the cleaner chamber is less than ½ full with water.

6. The device of claim 5 wherein the rim is configured so that between flushes the cleaner chamber is less than ¼ full with water.

7. The device of claim 1 comprising a water loading chamber between the water inlet chamber and the cleaner chamber passages and in liquid communication with the water inlet chamber and the passages.

8. The device of claim 6 wherein the loading chamber is below the cleaner chamber.

9. The device of claim 1 wherein the chamber passages comprising a plurality of openings in the chamber bottom.

10. A device for dispensing toilet bowl cleaner from a toilet tank to a toilet bowl of a toilet, the toilet tank having a water inlet tube and an overflow tube, wherein water flows from the water inlet tube when the toilet is flushed, the device comprising:

a. a housing;

b. an outlet for water flow from the device and configured for water passage connection to the overflow tube;

c. a rim around the outlet;

d. a cleaner chamber in the housing for receiving toilet bowl cleaner material, the cleaner chamber having a bottom;

e. a water inlet chamber within the housing for receiving substantially all of the water from the water inlet tube and configured so that water entering the water inlet chamber can pass over the rim into the outlet;

f. one or more cleaner chamber passages to the cleaner chamber for a portion of the water flowing into the water inlet chamber to pass into the cleaner chamber and for water containing cleaner to pass out of the cleaner chamber for passage to the outlet; and wherein the rim is configured so that between flushes the cleaner chamber is less than ½ full with water, and wherein the housing has a bottom with a space between the bottom of the housing and the bottom of the cleaner chamber, and wherein there are openings in the bottom wall of the cleaner chamber for drainage of water and cleansing material into the space.

11. The device of claim 10 wherein the rim is configured so that between flushes the cleaner chamber is less than ¼ full with water.

12. The device of claim 10 comprising a barrier in the cleaner chamber proximate to at least one passage.

13. The device of claim 10 wherein the least elevated portion of the rim is below the height of the bottom of all of the cleaner chamber passages.

14. A device for dispensing toilet bowl cleaner from a toilet tank to the toilet bowl of a toilet, the toilet tank having a water inlet tube and an overflow tube, the device comprising:

a. a housing;

b. an outlet from the housing and configured for water passage connection to the overflow tube;

c. a rim around the outlet;

d. a cleaner chamber in the housing for receiving toilet bowl cleaner material, the cleaner chamber having a bottom;

e. a water inlet chamber within the housing for receiving substantially all of the water from the water inlet tube and configured so that water entering the water inlet chamber can pass over the rim into the outlet;

f. one or more cleaner chamber passages to the cleaner chamber for a portion of the water flowing into the water inlet chamber to pass into the cleaner chamber and for water containing cleaner to pass out of the cleaner chamber for passage to the outlet; and g. a barrier in the cleaner chamber proximate to at least one passage;

wherein the housing has a bottom with a space between the bottom of the housing and the bottom of the cleaner chamber, and wherein there are openings in the bottom wall of the cleaner chamber for drainage of water and cleansing material into the space.

15. The device of claim 14 wherein the least elevated portion of the rim is below the height of the bottom of all of the cleaner chamber passages.

16. The device of claim 14 formed from first and second components, wherein the first component fits into the second component.

17. The device of claim 1 installed in a toilet with a cake of toilet bowl cleaner in the cleaner chamber.

18. The device of claim 4 wherein the first component comprises the cleaner chamber and the second component has the outlet and the water inlet chamber.

19. The device of claim 18 wherein the first component can be separated from the second component while leaving the second component installed in a toilet.

20. The device of claim 1 comprising a plurality of water inlet chambers.

21. A device for dispensing toilet bowl cleaner from a toilet tank to a toilet bowl of a toilet, the toilet tank having a water inlet tube and an overflow tube, the device comprising:

a. a housing;

b. an outlet for water flow from the device and configured for water passage connection to the overflow tube;

c. a rim around the outlet;

d. a cleaner chamber in the housing for receiving toilet bowl cleaner, the cleaner chamber having a bottom;

e. a water inlet chamber within the housing for receiving substantially all of the water from the water inlet tube and configured so that water entering the water inlet chamber can pass over the rim to the outlet;

f. one or more cleaner chamber passages to the cleaner chamber for a portion of the water flowing into the water inlet chamber to pass into the cleaner chamber and for water containing cleaner to pass out of the cleaner chamber for passage to the outlet;

g. at least one baffle in the cleaner chamber; and wherein the least elevated portion of the rim is no more than 10 mm higher than the bottom of all of the cleaner chamber passages.

22. The device of claim 21 comprising a barrier in the cleaner chamber proximate to at least one passage.

23. The device of claim 21 wherein the least elevated portion of the rim is below the height of the bottom of all of the cleaner chamber passages.

24. The device of claim 21 wherein the housing has a bottom with a space between the bottom of the housing and the bottom of the cleaner chamber, and wherein there are openings in the bottom of the cleaner chamber for drainage of water and cleansing material into the space.

25. The device of claim 21 formed from first and second components, wherein the first component fits into the second component.

26. The device of claim 21 wherein the rim is configured so that between flushes the cleaner chamber is less than ½ full with water.

27. The device of claim 26 wherein the rim is configured so that between flushes the cleaner chamber is less than ¼ full with water.

28. The device of claim 21 comprising a water loading chamber between the water inlet chamber and the cleaner chamber passages and in liquid communication with the water inlet chamber and the passages.

29. The device of claim 27 wherein the loading chamber is below the cleaner chamber.

30. The device of claim 21 wherein the chamber passages comprising a plurality of openings in the chamber bottom.

* * * * *